US006379280B1

(12) United States Patent
Ogawa et al.

(10) Patent No.: US 6,379,280 B1
(45) Date of Patent: Apr. 30, 2002

(54) CONTROL SYSTEM FOR INTERNAL COMBUSTION ENGINE

(75) Inventors: Ken Ogawa; Isao Komoriya; Shuji Nagatani, all of Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 44 days.

(21) Appl. No.: 09/655,442

(22) Filed: Sep. 5, 2000

(30) Foreign Application Priority Data

Sep. 6, 1999 (JP) ..... 11-252249

(51) Int. Cl.[7] ..... F02D 41/10

(52) U.S. Cl. ..... 477/107; 477/110; 701/110; 123/350

(58) Field of Search ..... 477/107, 110, 477/111; 701/110; 123/350

(56) References Cited

U.S. PATENT DOCUMENTS 5,884,605 A * 3/1999 Nagaishi et al. ..... 123/339.11
6,024,069 A * 2/2000 Yoshino ..... 123/295
6,024,670 A * 2/2000 Kitagawa et al. ..... 477/109
6,063,003 A * 5/2000 Kubota et al. ..... 477/43
6,167,863 B1 * 1/2001 Kazama et al. ..... 123/295

FOREIGN PATENT DOCUMENTS

JP 404022747 * 1/1992 ..... 123/350 X

* cited by examiner

*Primary Examiner*—Charles A Marmor
*Assistant Examiner*—Ha Ho
(74) *Attorney, Agent, or Firm*—Arent Fox Kintner Plotkin & Kahn, PLLC

(57) ABSTRACT

Control system for an internal combustion engine, for setting a desired torque in response to operating conditions of the engine and controlling torque based on the set desired torque. A crank angle position sensor detects an engine rotational speed. An accelerator position sensor detects an accelerator position. A required torque is calculated based on results of detection by the crank angle position sensor and the accelerator position sensor. Further, the calculated required torque is smoothed. Then, the present value of the required torque calculated at the present time and the smoothed required torque are compared with each other. When it is determined that the engine is being accelerated, an acceleration assist amount is calculated based on a difference value between the present value of the required torque and the smoothed required torque. Then, the acceleration assist amount is added to the smoothed required torque, whereby the desired torque is set.

6 Claims, 7 Drawing Sheets

CONTROL SYSTEM FOR INTERNAL COMBUSTION ENGINE

BACKGROUND OF THE INVENTION

1. Field of the Invention

This invention relates to a control system for an internal combustion engine, and more particularly to a control system that controls desired torque of an internal combustion engine installed on an automotive vehicle during acceleration of the engine.

2. Description of the Prior Art

Conventionally, a control system of this kind was proposed e.g. in Japanese Laid-Open Patent Publication (Kokai) No. 5-133257, in which a required torque T is calculated based on a sensed engine rotational speed and a sensed stepping amount of an accelerator pedal, and then a state of acceleration/deceleration of the engine is determined from the difference between the present value Ti and the immediately preceding value Ti−1 of the required torque T calculated. If it is determined that the engine is not being accelerated, i.e. does not require acceleration, a desired torque T' is set to the present value Ti of the required torque (T'=Ti), whereas if it is determined that the engine is being accelerated, i.e. requires acceleration, the required torque T is smoothed by using a smoothing value DTSET for calculation of the desired torque T'. During acceleration of the engine from a fuel-cut state, the smoothing value DTSET is set to and held at a smaller constant reference value DTSET0 until a predetermined time period has elapsed after the engine started to be accelerated, whereas after the lapse of the predetermined time period, the smoothing value DTSET is switched and set to a larger constant reference value DTSET1. The desired torque T' is calculated by adding the smoothing value set as above to the immediately preceding value Ti−1 of the required torque (T'=Ti−1+DTSET).

The desired torque T' calculated as above is converted to a desired throttle valve opening, and then the throttle valve is controlled such that its opening becomes equal to the desired throttle valve opening. As described above, in the above control system, at an initial stage of acceleration of the engine starting from the fuel-cut state, the required torque is smoothed to a larger degree to thereby ensure drivability, and thereafter, the degree of smoothing is reduced to thereby ensure acceleration response of the engine.

However, in the above conventional control system, when it is determined that the engine is being accelerated, the required torque T is smoothed by using the smoothing value DTSET which is a fixed value all through the acceleration, and hence it is impossible to obtain an acceleration response of the engine excellent enough to meet a driver's demand, which causes a sense of tardiness in acceleration especially at the initial stage of the acceleration at which the degree of smoothing of the required torque is large. Further, in the control system, during acceleration of the engine, the desired torque T' is set to the sum of the immediately preceding required torque value Ti−1 and the smoothing value DTSET (T'=Ti−1+DTSET), and except during the acceleration, it is set to the present required torque value Ti (T'=Ti), which means that, basically, the required torque T determined directly from the engine rotational speed and the stepping amount of the accelerator pedal serves as a basic value of the desired torque T'. For this reason, the basic value varies in a manner oversensitive even to slight changes in the driver's operation of the accelerator pedal, and the desired torque T' is readily changed accordingly. Therefore, the behavior of the vehicle is liable to become unstable, and hence, drivability is degraded particularly when the accelerator pedal is repeatedly fully stepped on and released.

SUMMARY OF THE INVENTION

It is an object of the invention to provide a control system for an internal combustion engine for an automotive vehicle, which is capable of setting a desired torque appropriately during acceleration of the engine, thereby ensuring an excellent response of the engine and drivability of the vehicle.

To attain the above object, the present invention provides a control system for an internal combustion engine, for setting a desired torque in response to operating conditions of the engine and controlling torque based on the set desired torque.

The control system according to the invention is characterized by comprising:

- rotational speed-detecting means for detecting an engine rotational speed;
- accelerator position-detecting means for detecting an accelerator position;
- required torque-calculating means for calculating a required torque, based on results of detection by the rotational speed-detecting means and the accelerator position-detecting means;
- required torque-smoothing means for smoothing the required torque calculated by the required torque-calculating means;
- acceleration-determining means for comparing a present value of the required torque calculated by the required torque-calculating means at a present time with the smoothed required torque smoothed by the required torque-smoothing means, to thereby determine whether or not the engine is being accelerated;
- acceleration assist amount-calculating means for calculating an acceleration assist amount, based on a difference value between the present value of the required torque and the smoothed required torque, when the acceleration-determining means determines that the engine is being accelerated; and
- desired torque-setting means for adding the acceleration assist amount to the smoothed required torque to thereby set the desired torque.

According to this control system, the required torque-calculating means calculates the required torque based on the sensed engine rotational speed and accelerator position, and the required torque-smoothing means smoothes the required torque calculated by the required torque-calculating means, to thereby determine the smoothed required torque. Further, the acceleration-determining means compares the present value of the required torque calculated by the required torque-calculating means with the smoothed required torque smoothed by the required torque-smoothing means, to thereby determine whether or not the engine is being accelerated. Then, when it is determined that the engine is being accelerated, the acceleration assist amount-calculating means calculates the acceleration assist amount, based on the difference value between the present value of the required torque and the smoothed required torque. Further, the desired torque-setting means adds the acceleration assist amount to the smoothed required torque to thereby set the desired torque.

As described above, in the control system according to the invention, the present value of the required torque and the smoothed required torque are compared with each other, whereby it is determined whether the engine is being accelerated. Further, the acceleration assist amount is calculated based on the difference value between the present value of the required torque and the smoothed required torque, and then the acceleration assist amount is added to the smoothed required torque, whereby the desired torque is set. Therefore, the acceleration assist amount properly determined according to the degree of acceleration of the engine can be added to the required torque while reflecting the driver's demand for acceleration in real time, so that it is possible to ensure an excellent acceleration response of the engine and thereby eliminate tardiness in acceleration of the vehicle. Further, in place of the required torque calculated directly from the engine rotational speed and the accelerator position, the smoothed required torque is employed as a basic value of the desired torque to which the acceleration assist amount is to be added, so that the basic value of the desired torque is prevented from varying in a manner oversensitive to changes in the driver's operation of the accelerator, which makes it possible to stabilize the behavior of the vehicle and hence ensure excellent drivability.

Preferably, the acceleration assist amount-calculating means calculates the acceleration assist amount such that the acceleration assist amount is progressively increased during a start of the acceleration mode and progressively reduced during an end of the acceleration mode.

According to this preferred embodiment, the acceleration assist amount is progressively increased during the start of the acceleration mode of the engine and progressively reduced during the end of the same, which enables acceleration of the engine to be smoothly started and ended without causing sharp changes in the desired torque. Therefore, even when the accelerator pedal is fully stepped on and released repeatedly, it is possible to stabilize the behavior of the vehicle and hence ensure excellent drivability.

More preferably, the engine includes a transmission, and the control system further comprises change gear ratio-detecting means for detecting a change gear ratio of the transmission of the engine, the acceleration assist amount-calculating means calculating the acceleration assist amount such that the acceleration assist amount is larger as the change gear ratio detected by the change gear ratio-detecting means is smaller.

In general, torque required during acceleration of the engine is larger as the change gear ratio (reduction gear ratio) is smaller. Therefore, according to the above preferred embodiment, since the acceleration assist amount is calculated such that it becomes larger as the selected change gear ratio is smaller, it is possible to obtain an excellent acceleration response adapted to the selected change gear ratio.

Preferably, the smoothing by the required torque-smoothing means is carried out by calculating an average value of a predetermined number of values of the required torque calculated up to the present time.

Preferably, the control system further comprises start assist amount-calculating means for calculating a start assist amount based on said engine rotational speed and said accelerator position, and said desired torque-setting means adds said acceleration assist amount and said start assist amount to said smoothed required torque to thereby set said desired torque.

The above and other objects, features, and advantages of the invention will become apparent from the following detailed description taken in conjunction with the accompanying drawings.

DETAILED DESCRIPTION

The invention will now be described in detail with reference to the drawings showing an embodiment thereof.

Figure 1:
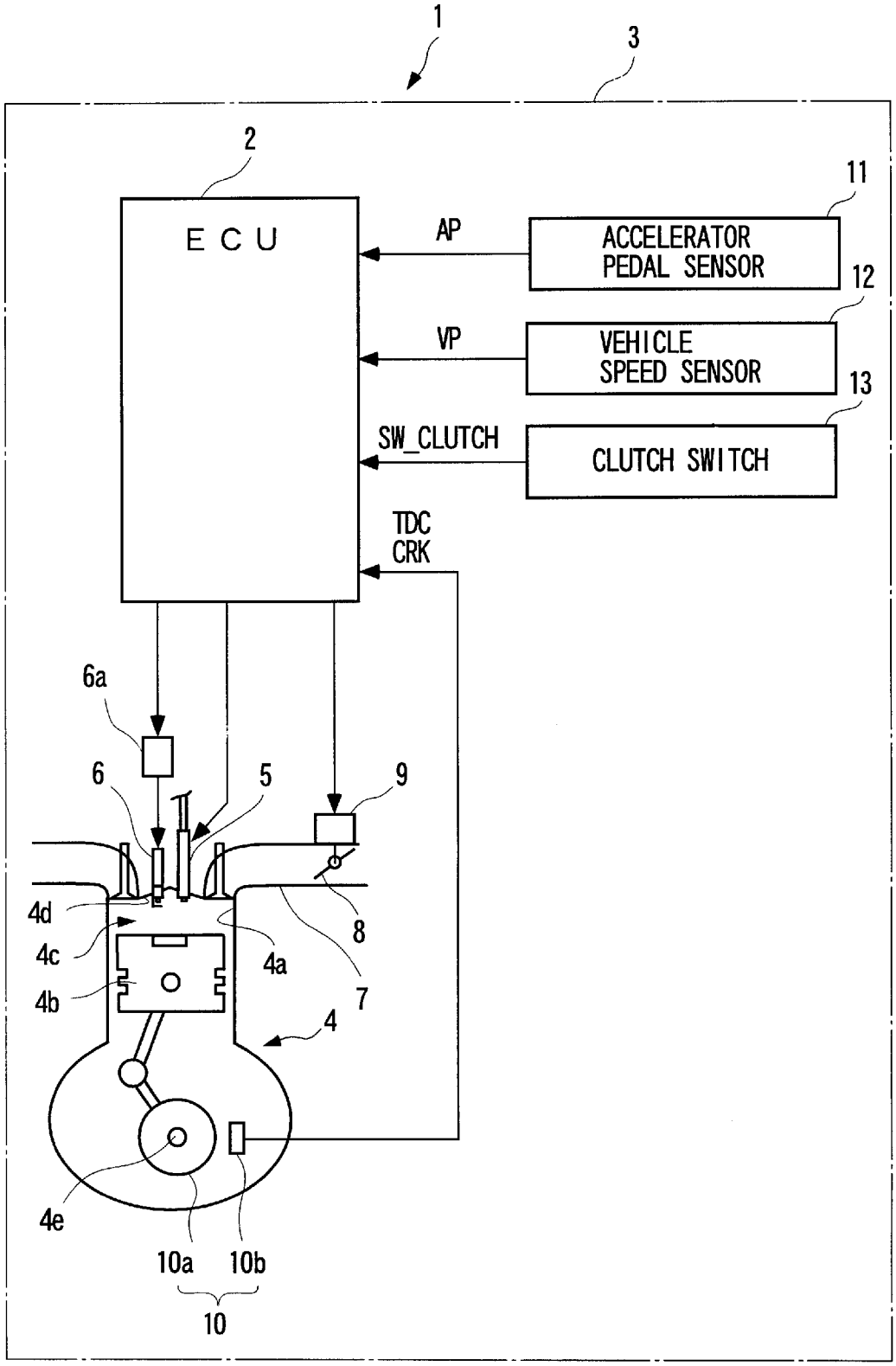
FIG. 1 is a block diagram schematically showing the whole arrangement of a control system for an internal combustion engine, according to an embodiment of the invention.

Referring first to FIG. 1, there is schematically shown the whole arrangement of a control system to which is applied the present invention. As shown in the figure, the control system 1 includes an ECU (required torque-calculating means, required torque-smoothing means, acceleration-determining means, acceleration assist amount-calculating means, desired torque-setting means, start assist amount-calculating means) 2. As described in detail hereinafter, the ECU 2 controls torque of the internal combustion engine (hereinafter simply referred to as "the engine") 4.

The engine 4 is e.g. a straight type four-cylinder gasoline engine installed on an automotive vehicle (manual transmission (MT) vehicle), not shown. The engine 4 includes cylinders 4*a* and pistons 4*b* (only one of the cylinders 4*a* and a corresponding one of the pistons 4*b* are shown in the figure). Between the piston 4*b* and a cylinder head 4*d* , there is formed a combustion chamber 4*c*. The cylinder head 4*d* has a fuel injection valve (hereinafter simply referred to as "the injector") 5 and a spark plug 6 mounted therein such that they are inserted into the combustion chamber 4*c*. The engine 4 is a so-called direct injection engine in which fuel is directly injected into the combustion chamber 4*c*.

The injector 5 is connected to the ECU 2, and a fuel injection time period over which the injector 5 carries out fuel injection, i.e. a fuel supply amount, and a fuel injection timing at which the injector 5 starts the fuel injection are controlled by a drive signal delivered from the ECU 2 to the injector 5. Further, the spark plug 6 is connected to the ECU 2 via an ignition coil 6*a*, and a high voltage is applied to the spark plug 6 via the ignition coil 6*a*, at an ignition timing indicated by a drive signal delivered from the ECU2 for electric discharge, whereby an air-fuel mixture is burned in the combustion chamber 4*c*.

The ECU 2 controls the operation of the engine 4 such that the combustion mode thereof is switched between a stratified combustion mode and a homogeneous combustion mode, by controlling the fuel injection time period and fuel injection timing of the injector 5 and the ignition timing of the spark plug 6 in dependence on operating conditions of the engine 4. More specifically, the stratified combustion mode is executed mainly during low-load operation of the engine 4, such as idling, and in this mode, fuel is injected into the combustion chamber 4*c* through the injector 5 during a second half of a compression stroke to cause a very lean air-fuel mixture to be unevenly distributed in the combustion chamber or concentrated in the vicinity of the spark plug 6, and the mixture is burned by stratified combustion. On the other hand, the homogeneous combustion mode is carried out mainly during high-load operation of the engine 4, and in this mode, fuel is injected into the combustion chamber 4*c* through the injector 5 during a first half of an intake stroke to cause a richer air-fuel mixture to be homogeneously distributed in the combustion chamber 4*c* than in the stratified combustion mode, and the mixture is burned by homogeneous combustion.

Arranged in an intermediate portion of an intake pipe 7 of the engine 4 is a throttle valve 8 which is connected to a stepping motor 9. The stepping motor 9 is electrically connected to the ECU 2 and changes a throttle valve opening θ TH which is a degree of opening of the throttle valve 8 in response to a drive pulse signal from the ECU 2, whereby the amount of intake air supplied to the combustion chamber 4*c* through the intake pipe 7 is adjusted.

Further, the engine 4 is provided with a crank angle position sensor (rotational speed-detecting means) 10 formed of a magnet rotor 10*a* and an MRE (magnetic resistance element) pickup which are mounted to a crankshaft 4*e* of the engine 4. The crank angle position sensor 10 senses the rotational angle of the crankshaft 4*e* and generates pulses of the CRK signal in accordance with rotation of the same. The CRK signal is indicative of the sensed rotational angle of the crankshaft 4*e*, and each pulse thereof is generated whenever the crankshaft rotates through a predetermined angle (e.g. one degree) and supplied to the ECU 2. The ECU 2 determines a rotational speed NE of the engine 4 (engine rotational speed), based on the CRK signal. Further, the crank angle position sensor 10 outputs a TDC signal. The TDC signal is a pulse signal and each pulse of the TDC signal indicates that the piston 4*b* in each cylinder of the engine 4 is in the vicinity of a top dead center position at the start of an intake stroke. In the four-cylinder engine 4 of the present embodiment, TDC signal pulses are each generated whenever the crankshaft 4*e* rotates through 180 degrees.

Further, an accelerator position sensor 11, a vehicle speed sensor 12, a gear position sensor 13, and a clutch switch 14 are connected to the ECU 2. The accelerator position sensor (accelerator position-detecting means) 11 detects the operation amount or stepping amount (hereinafter referred to as "the accelerator position AP") of an accelerator pedal, not shown, of the automotive vehicle, and supplies an electric signal AP indicative of the sensed accelerator position to the ECU 2. The vehicle speed sensor 12 detects a traveling speed of the vehicle (hereinafter referred to as "the vehicle speed VP") and is formed of a magnet rotor and an MRE pickup, not shown, mounted to an axle, not shown, of the vehicle. The gear position sensor (change gear ratio-detecting means) 13 is arranged e.g. at a location facing a shift lever, not shown, for detecting the gear position NGR of a transmission 20 of the engine 4. In a 5-speed vehicle, for instance, the gear position sensor 13 detects a gear position currently selected within a range of the first speed position to the fifth speed position and supplies an electric signal NGR indicative of the sensed gear position to the ECU 2. The clutch switch 14 detects a state of engagement of a clutch, not shown, and an output value $SW_{13}$ CLUTCH therefrom assumes "0" when the clutch pedal is stepped on by a stepping amount equal to or larger than a predetermined amount, whereas when the stepping amount of the clutch pedal is smaller than the predetermined amount, the output value SW_CLUTCH assumes "1".

The ECU 2 is formed by a microcomputer, not shown, including a CPU, a RAM, a ROM, and an I/O interface. The signals from the sensors 10 to 13 and the clutch switch 14 are each delivered to the ECU 2, and after A/D conversion and waveform shaping at the I/O interface, they are input into the CPU. In response to these signals, the CPU determines operating conditions of the engine 4, based on control programs and tables stored in the ROM, and then determines how to control the engine 4, depending on the determined operating conditions of the engine 4. Thereafter, the CPU outputs drive signals based on the determination via the I/O interface to thereby control the engine 4.

More specifically, the CPU sets a desired torque PMCMDREG based on the determined operating conditions of the engine 4, and then delivers a drive signal based on the desired torque PMCMDREG to the stepping motor 9 to thereby control the throttle valve opening. Further, the CPU determines whether the engine 4 is to be operated in the stratified combustion mode or in the homogeneous combustion mode, based on the operating conditions of the engine 4, calculates the time period and timing of fuel injection by the injector 5 and the timing of ignition by the spark plug 6, based on a result of the determination, and then delivers drive signals based on results of the calculations to the injector 5 and the spark coil 6*a*, respectively, to thereby control the same.

Figure 2:
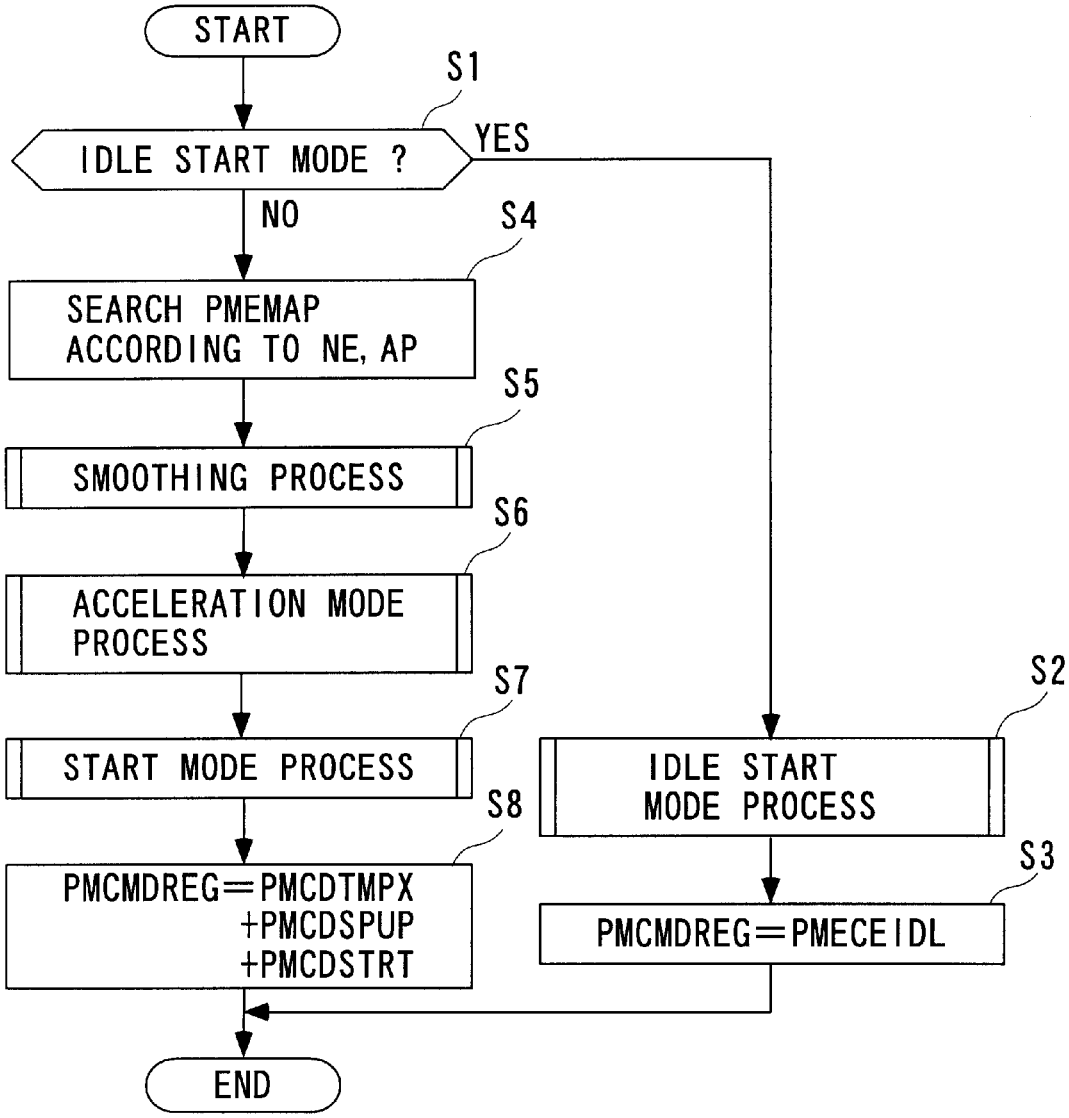
FIG. 2 is a flowchart showing a main routine of a control program for setting a desired torque PMCMDREG, which is executed by the FIG. 1 control system.

FIG. 2 shows a main routine of a control program for setting the desired torque PMCMDREG. The present program is executed by the CPU of the ECU 2 at predetermined time intervals.

First, at a step S1, it is determined whether or not the engine 4 is in an idle start mode. The idle start mode means a state in which the vehicle is being started from an idling condition of the engine simply by operation of the clutch. The determination at the step S1 is carried out based on whether or not there are satisfied all the following conditions: the engine 4 is in an idling condition; the vehicle speed VP is equal to or lower than a predetermined vehicle speedX_VPIS (e.g. 5 km/h); the output value SW_CLUTCH from the clutch switch 14 is equal to "0", i.e. the clutch pedal is stepped on; and the engine rotational speed NE is equal to or lower than a predetermined rotational speed NEIDST (e.g. 500 rpm) which is lower than a normal idling rotational speed.

If the answer to the question of the step S1 is affirmative (Yes), i.e. if the engine 4 is in the idle start mode, the program proceeds to a step S2, wherein an idle start mode process is carried out. Although detailed description of the idle start mode process is omitted, in this process, an idle start-time required torque PMECEIDL is determined as required torque based on the engine rotational speed NE, and the combustion mode of the engine 4 is set to the homogeneous combustion mode which is carried out by controlling the air-fuel ratio of an air-fuel mixture supplied to the engine to a stoichiometric air-fuel ratio. Then, the idle start-time required torque PMECEIDL determined at the step S2 is set to the desired torque PMCMDREG at a step S3, followed by terminating the program. This loop not only prevents occurrence of an engine stall during the idle start mode of the engine 4, but also ensures starting toughness after termination of the idle start mode.

On the other hand, if the answer to the question of the step S1 is negative (No), i.e. if the engine 4 is not in the idle start mode, the program proceeds to steps S4 et seq., wherein processes other than the idle start mode process are carried out.

At the step S4, a required torque map, not shown, stored in the ROM is searched based on the engine rotational speed NE and the accelerator position AP, so as to obtain a required torque PMEMAP. Then, the program proceeds to a step S5, wherein the required torque PMEMAP is smoothed. Although detailed description of the smoothing process is omitted, in this process, a smoothed required torque PMCDTMPX is calculated by averaging a predetermined number of values of the required torque PREMAP, i.e. the present value PMEMAPn obtained in the present loop and other values retrieved in preceding loops and stored in the RAM. The smoothed required torque PMCDTMPX is thus obtained as an average value of the predetermined number of values of the required torque PREMAP obtained in the present and preceding loops, and set to a basic value for determining the desired torque PMCMDREG, as described in detail hereinafter, whereby the drivability is properly ensured against changes in the required torque.

Figure 3:
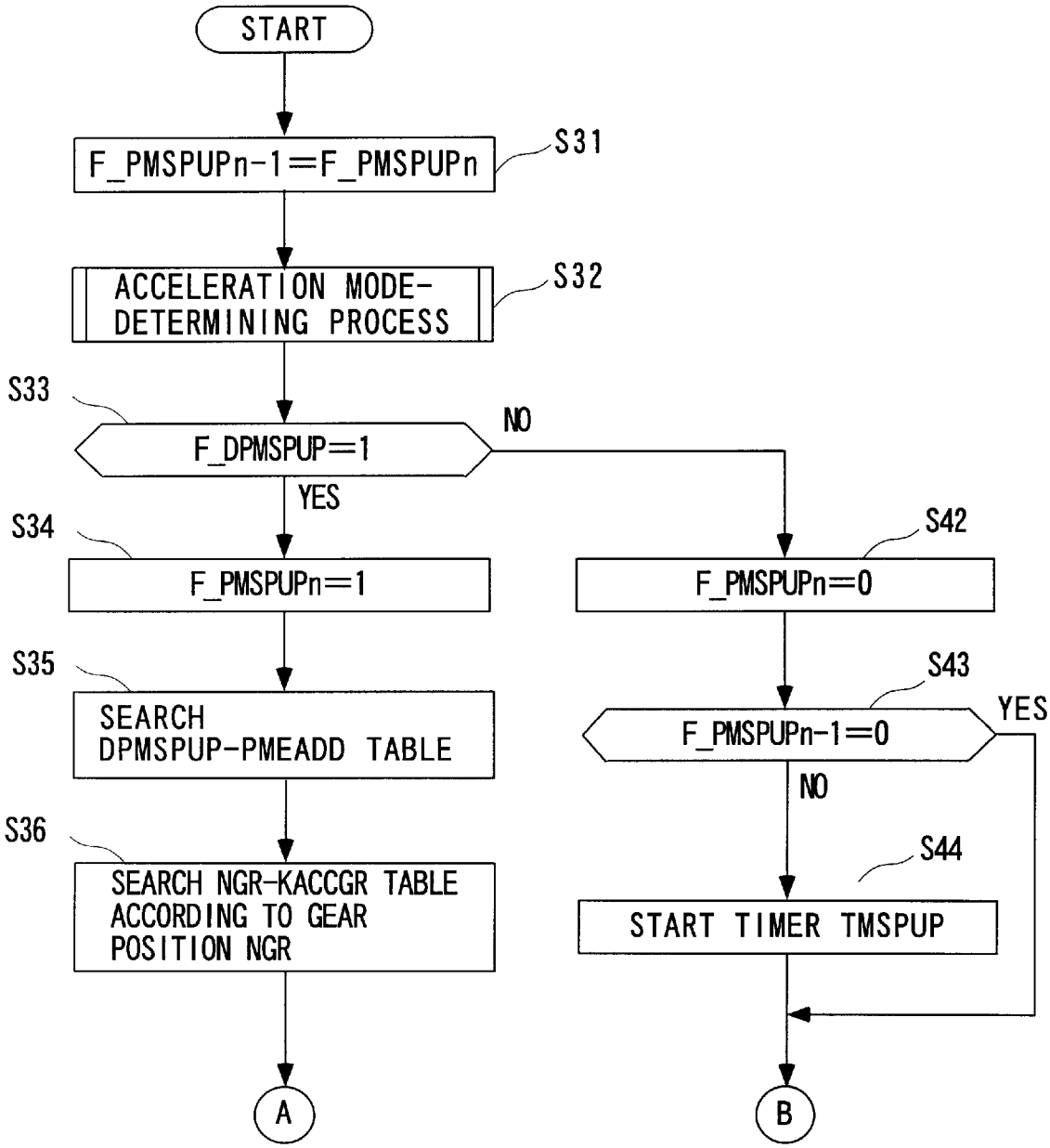
FIG. 3 is a flowchart showing a subroutine for carrying out an acceleration mode process in FIG. 2.
Figure 4:
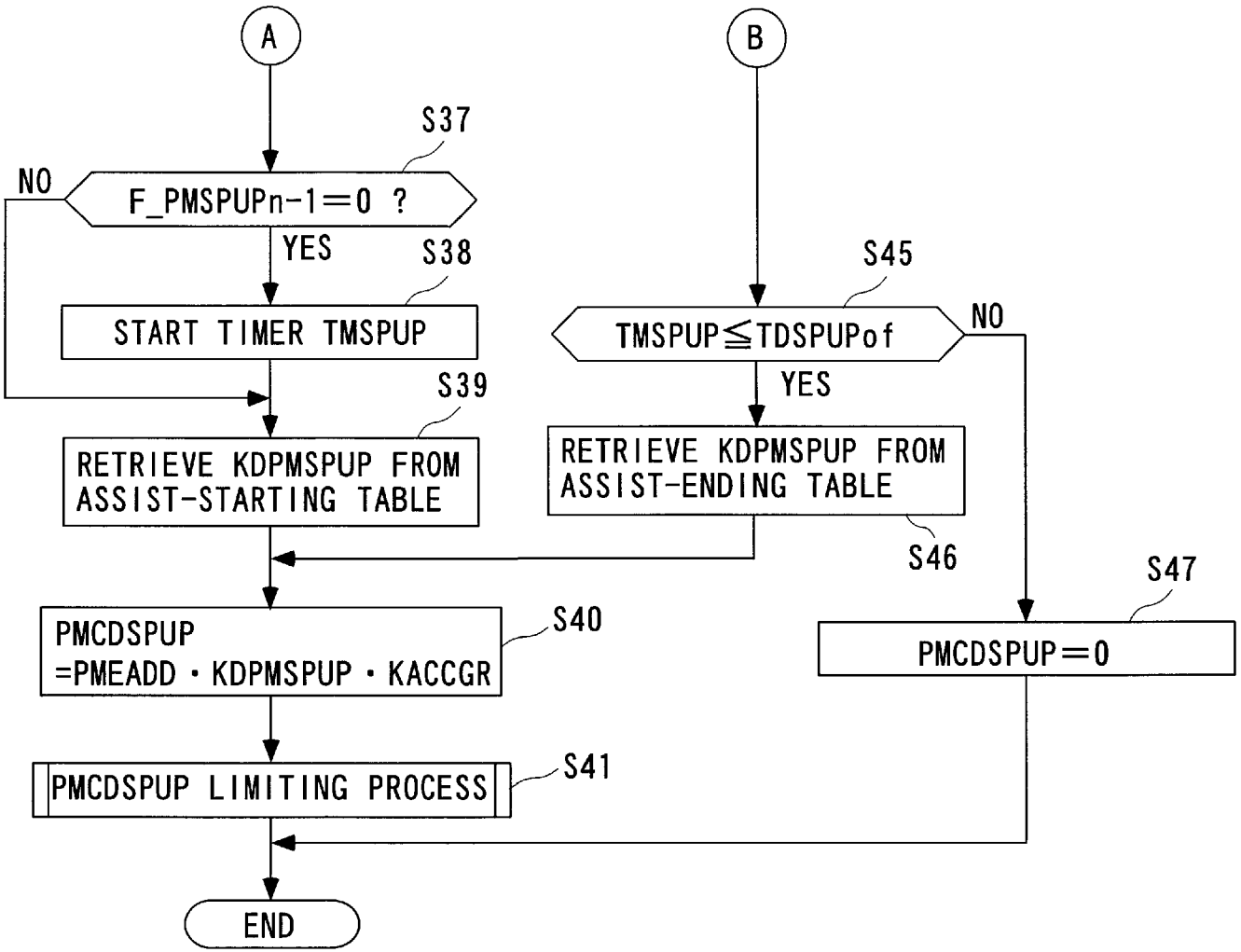
FIG. 4 is a continued part of the FIG. 3 flowchart.

Then, the program proceeds to the step S6, wherein an acceleration mode process according to the present invention is carried out. FIGS. 3 and 4 show a subroutine for executing the acceleration mode process. First, at a step S31, a value of an acceleration mode flag stored in the RAM as the present value F_PMSPUPn is set to the immediately preceding value F_PMSPUPn-1 of the flag. The acceleration mode flag (present value F_PMSPUPn) is set to "1" at a step S34 when the engine 4 is determined to be in an acceleration mode by an acceleration mode-determining process which is executed at the following step S32.

Figure 5:
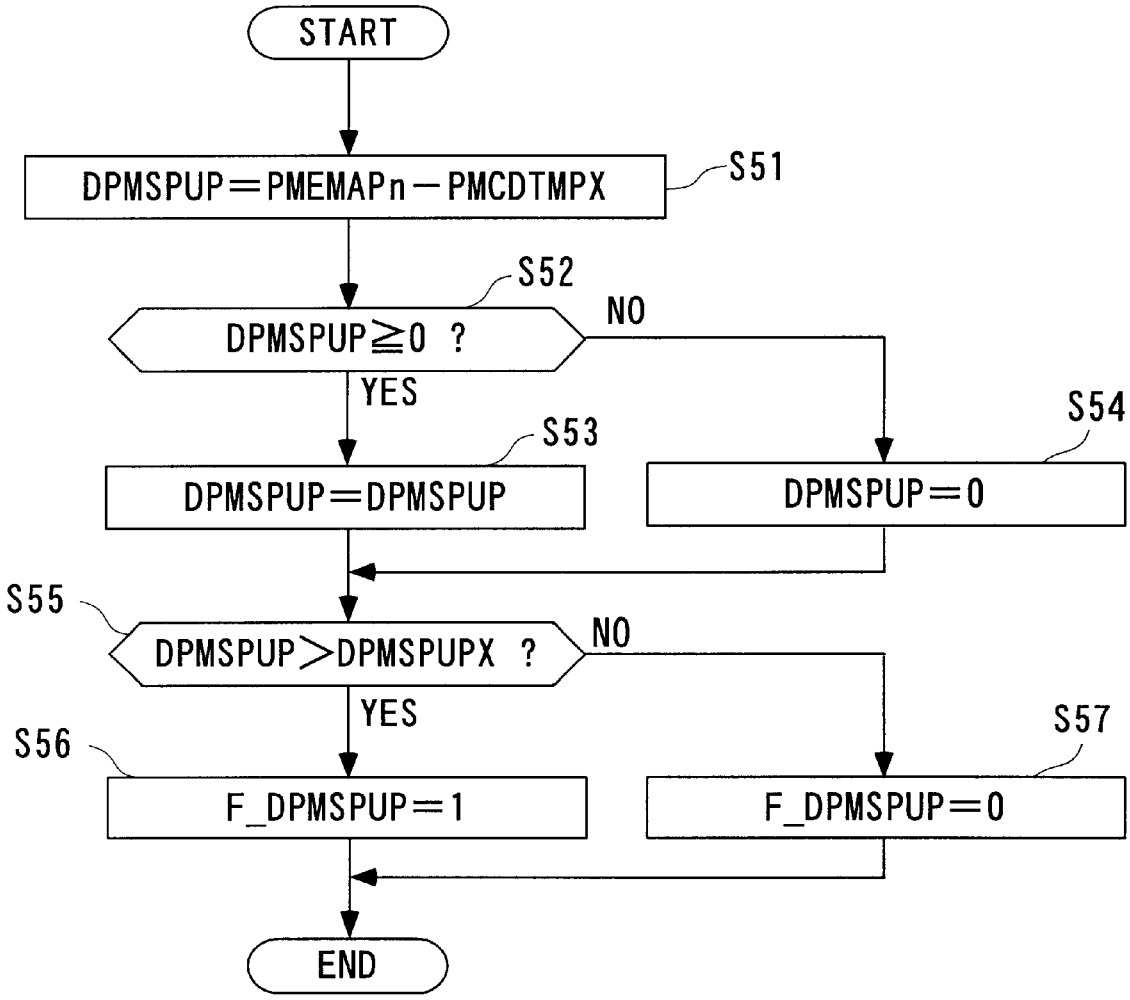
FIG. 5 is a flowchart showing a subroutine for carrying out an acceleration mode-determining process in FIG. 3.

FIG. 5 shows a subroutine for carrying out the acceleration mode-determining process. First, a difference value DPMSPUP (hereinafter referred to as "the required torque difference value") between the present value PMEMAPn of the required torque determined at the step S4 and the smoothed required torque PMCDTMPX calculated at the step S5 is calculated at a step S51. Then, it is determined at a step S52 whether or not the required torque difference value DPMSPUP is equal to or larger than "0". If DPMSPUP≧0 holds, at the following step S53, the required torque difference value DPMSPUP continues to be set to the value obtained at the step S51, and the program proceeds to a step S55, whereas if DPMSPUP<0 holds, the required torque difference value DPMSPUP is set to "0" at a step S54, followed by the program proceeding to the step S55.

At the step S55, it is determined whether or not the required torque difference value DPMSPUP is larger than a predetermined value DPMSPUPX. If the answer to the question is affirmative (Yes), i.e. if DPMSPUP>DPMSPUPX holds, it is judged that the engine 4 is in the acceleration mode, and an acceleration mode determination flag F_DPMSPUP is set to "1" at a step S56, followed by terminating the acceleration mode-determining process. On the other hand, if the answer to the question is negative (No), i.e. if DPMSPUP≦DPMSPUPX holds, it is judged that the engine 4 is not in the acceleration mode, and the acceleration mode determination flag F_DPMSPUP is set to "0" at a step S57, followed by terminating the acceleration mode-determining process. It should be noted that the predetermined value DPMSPUPX is provided with a hysteresis, which prevents hunting of the acceleration mode determination and acceleration mode process control, described in detail hereinafter, which is executed based on the result of the acceleration mode determination.

Referring again to FIG. 3, at a step S33 following the acceleration mode-determining process, it is determined whether or not the acceleration mode determination flag F_DPMSPUP set by the acceleration mode-determining process assumes "1". If the answer to the question is affirmative (Yes), the engine 4 is judged to be in the acceleration mode in the present loop, and the present value F_PMSPUPn of the acceleration mode flag is set to "1" at the step S34. Then, the acceleration mode process is executed at a step S35 et seq.

Figure 6:
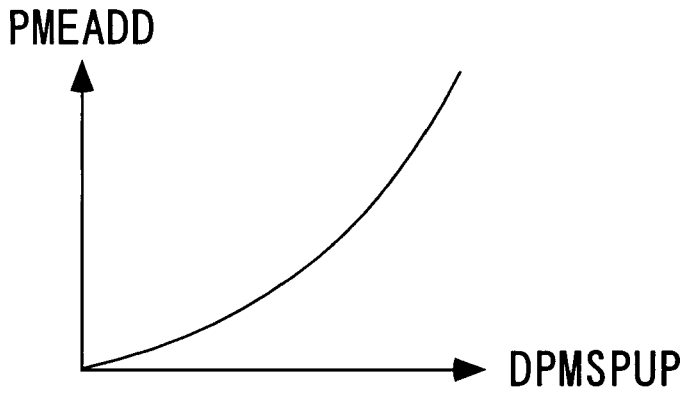
FIG. 6 is a diagram showing an example of a DPMSPUP (required torque difference value)-PMEADD (basic value of an acceleration assist amount) table.

At the step S35, a DPMSPUP-PMEADD table stored in the ROM is searched based on the required torque difference value DPMSPUP calculated by the acceleration mode-determining process, to thereby obtain a basic value PMEADD of an acceleration assist amount PMCDSPUP. FIG. 6 shows an example of the DPMSPUP-PMEADD table. The table is set such that the basic value PMEADD becomes larger as the required torque difference value DPMSPUP is larger. The required torque difference value DPMSPUP is the difference between the present value PMEMAPn of the required torque and the smoothed required torque PMCDTMPX as described above, and hence by setting the basic value PMEADD of the acceleration assist amount PMCDSPUP as above, it is possible to set the acceleration assist amount PMCDSPUP to a suitable value dependent on the degree of acceleration in real time.

Figure 7:
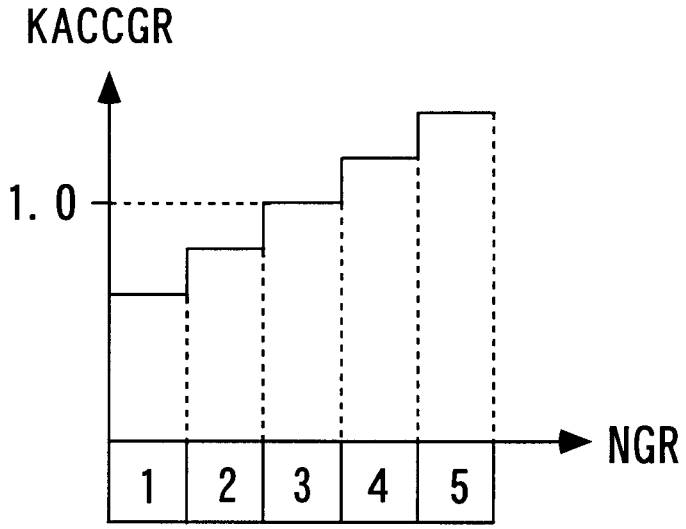
FIG. 7 is a diagram showing an example of a NGR (gear position)-KACCGR (gear position-dependent correction coefficient) table.

Then, another table (NGR-KACCGR table) stored in the ROM is searched based on the gear position NGR detected by the gear position sensor 13, to thereby determine a gear position-dependent correction coefficient KACCGR for correcting the acceleration assist amount PMCDSPUP. FIG. 7 shows an example of the NGR-KACCGR table. In this table, the abscissa represents a gear position NGRi (i=1 to 5) selected within a range of the first speed to the fifth speed. As shown in the figure, the gear position-dependent correction coefficient KACCGR is set on a gear position-by-gear position basis, such that when the gear position is the third speed, the coefficient KACCGR is equal to 1.0, and the higher the gear position is, the larger the coefficient KACCGR is.

Then, at a step S37, it is determined whether or not the immediately preceding value F_PMSPUPn-1 of the acceleration mode flag is equal to "0". If the answer to the question is affirmative (Yes), it is judged that the present loop is being executed as a first loop after the engine 4 entered the acceleration mode, and a timer TMSPUP formed by an upcounter is started at a step S38. On the other hand, if the answer to the question is negative (No), it is judged that the present loop is being executed as a second or later loop after the engine 4 entered the acceleration mode, and the step S38 is skipped, followed by the program proceeding to a step S39. This means that the count of the timer TMSPUP represents a time period which has elapsed after the engine 4 entered the acceleration mode.

Figure 8:
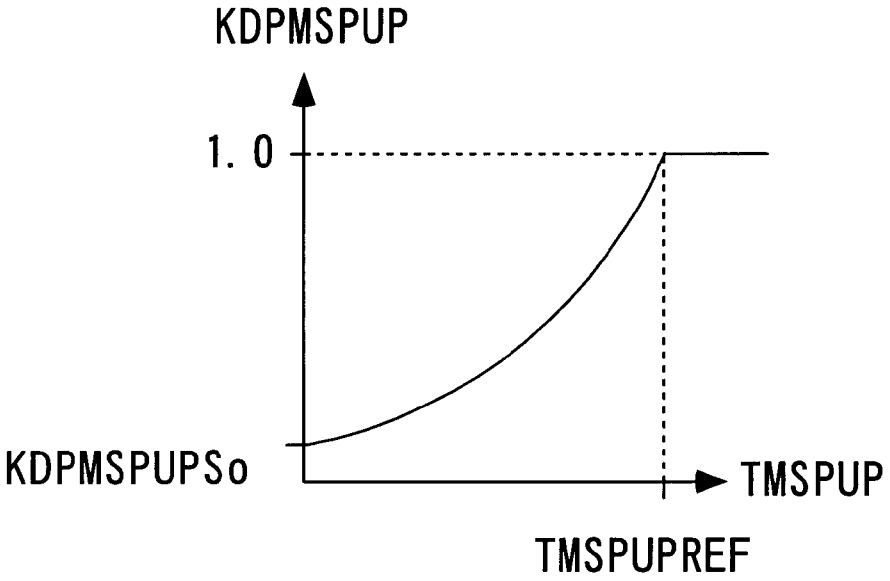
FIG. 8 is a diagram showing an example of an assist-starting table.

At the step S39, an assist-starting table stored in the ROM is searched based on the count of the timer TMSPUP, to thereby determine a time-dependent correction coefficient KDPMSPUP for correcting the acceleration assist amount PMCDSPUP. FIG. 8 shows an example of the assist-starting table. The table is set such that the time-dependent correction coefficient KDPMSPUP has an initial value KDPMSPUPSo set to a predetermined value larger than "0", and is progressively increased as the count TMSPUP becomes larger, i.e. with the lapse of time after the engine 4 entered the acceleration mode, and set to 1.0 when and after the count TMSPUP has reached a predetermined value TMSPUPREF, i. e. when a predetermined time period has elapsed after the engine 4 entered the acceleration mode.

Then, at a step S40, the basic value PMEADD obtained at the step S35 is multiplied by the gear position-dependent correction coefficient KACCGR obtained at the step S36 and the time-dependent correction coefficient KDPMSPUP obtained at the step S39, to thereby calculate the acceleration assist amount PMCDSPUP. Finally, at a step S41, a limiting process is carried out to limit the acceleration assist amount PMCDSPUP to a value which is equal to or lower than a predetermined upper limit value, followed by terminating the program.

On the other hand, if the answer to the question of the step S33 is negative (No), i.e. if it is determined that the acceleration mode determination flag F-DPMSPUP is set to "0", by the acceleration mode-determining process, it is judged that the engine 4 is not in the acceleration mode in the present loop, the present value F_PMSPUPn of the acceleration mode flag is set to "0" at a step S42, and then processing for terminating the acceleration mode process is executed at a step S43 et seq.

First, at the step S43, it is determined whether or not the immediately preceding value F_PMSPUPn-1 of the acceleration mode flag is equal to "0". If the answer to the question is negative (No), it is judged that the present loop is being executed as a first loop after the engine 4 left the acceleration mode, and the timer TMSPUP is started at a step S44. On the other hand, if the answer to the question is affirmative (No), it is judged that the present loop is being executed as a second or later loop after the engine 4 left the acceleration mode, and the step S44 is skipped, followed by the program proceeding to a step S45.

Figure 9:
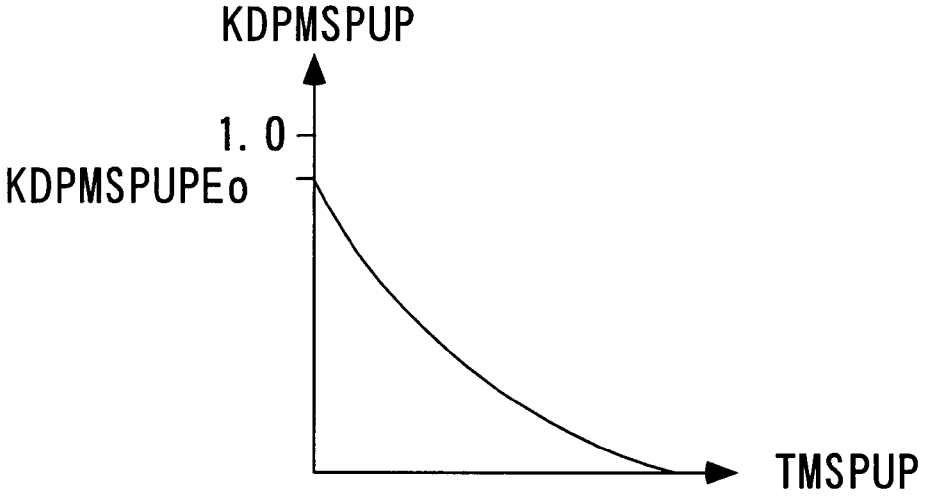
FIG. 9 is a diagram showing an example of an assist-ending table.

At the step S45, it is determined whether or not the count of the timer TMSPUP is equal to or smaller than a predetermined value TMSPUPof. If the answer to the question is affirmative (Yes), i.e. if a predetermined time period has not elapsed after the engine 4 left the acceleration mode, an assist-ending table stored in the ROM is searched based on the count TMSPUP, to thereby determine the time-dependent correction coefficient KDPMSPUP for the end of the acceleration mode. FIG. 9 shows an example of the assist-ending table. The table is set such that the time-dependent correction coefficient KDPMSPUP has an initial value KDPMSPUPEo set to a predetermined value smaller than "1.0 ", and is progressively reduced as the count TMSPUP becomes larger, i.e. with the lapse of time after the engine 4 left the acceleration mode. Then, the program proceeds to the steps S40 and S41. At the step S40, the acceleration assist amount PMCDSPUP is calculated by using the time-dependent correction coefficient KDPMSPUP obtained at the step S46, and at the step S41, the limiting process is executed, followed by terminating the program.

On the other hand, if the answer to the question of the step S45 is negative (No), i.e. if the count TMSPUP is larger than the predetermined value TDSPUPof, which means that the predetermined time period has elapsed after the engine 4 left the acceleration mode, the acceleration assist amount PMCDSPUP is set to "0" at a step S47, followed by terminating the program. The acceleration mode process of the step S6 in FIG. 2 is executed as above.

Referring again to FIG. 2, at a step S7 following the acceleration mode process, a start mode process is executed. Although detailed description of the start mode process is omitted, in this process, when the clutch has already been engaged (SW_CLUTCH=1), and the vehicle speed VP is equal to or lower than a predetermined value, it is determined that the engine 4 is in the start mode, and a start assist amount PMCDSTRT is calculated based on the present values of the engine rotational speed NE and the accelerator position AP. The start assist amount PMCDSTRT thus calculated is added to the smoothed required torque PMCDTMPX, for setting the desired torque PMCMDREG, as described hereinbelow. As a result, sufficient torque reflecting the intention of the driver is generated to eliminate tardiness in the start of the vehicle.

Then, at a step S8, the acceleration assist amount PMCDSPUP obtained by the acceleration mode process at the step S6 and the start assist amount PMCDSTRT obtained by the start mode process at the step S7 are added to the smoothed required torque PMCDTMPX obtained by the smoothing process at the step S5, to thereby calculate the desired torque PMCMDREG, followed by terminating the program.

As described above, according to the present embodiment, the present value PMEMAPn of the required torque determined based on the engine rotational speed NE and the accelerator position AP, and the smoothed required torque PMCDTMPX obtained as an average value of the predetermined number of values of the required torque PMEMAP obtained in the present and preceding loops are compared with each other to thereby determine a state of acceleration. Further, the basic value PMEADD of the acceleration assist amount PMCDSPUP is calculated based on the required torque difference value DPMSPUP obtained as a difference value between the present value PMEMAPn of the required torque and the smoothed required torque PMCDTMPX (see FIG. 6), and then the acceleration assist amount PMCDSPUP calculated based on the basic value PMEADD is added to the smoothed required torque PMCDTMPX to thereby set the desired torque PMCMDREG. Therefore, the acceleration assist amount PMCDSPUP properly determined according to the degree of acceleration can be added to the required torque while reflecting the driver's demand for acceleration in real time, so that it is possible to ensure an excellent acceleration response of the engine and thereby eliminate tardiness in acceleration of the vehicle.

Further, as described above, in place of the required torque PMEMAP determined directly from the engine rotational speed NE and the accelerator position AP, the smoothed required torque PMCDTMPX obtained by averaging the predetermined number of values of the required torque PMEMAP including the present value is employed as a basic value of the desired torque PMCMDREG to which the acceleration assist amount PMCDSPUP is to be added. As a result, the basic value of the desired torque PMCMDREG is prevented from varying in a manner oversensitive to changes in the driver's operation of the accelerator (pedal), which makes it possible to stabilize the behavior of the vehicle and hence ensure excellent drivability.

Further, the acceleration assist amount PMCDSPUP is corrected by the time-dependent correction coefficient KDPMSPUP (see FIGS. 8 and 9) and thereby set such that it is progressively increased during the start of the acceleration mode of the engine and progressively reduced during the end of the same, which enables acceleration of the engine to be smoothly started and ended without causing sharp changes in the desired torque PMCMDREG. Therefore, even when the accelerator pedal is fully stepped on and released repeatedly, it is possible to stabilize the behavior of the vehicle to thereby ensure excellent drivability.

Moreover, the acceleration assist amount PMCDSPUP is corrected by the gear position-dependent correction coefficient KACCGR (see FIG. 7) and thereby set such that it becomes larger as the selected gear position is higher, i.e. as the change gear ratio (reduction gear ratio) is smaller. Therefore, it is possible to obtain an excellent acceleration response of the engine in a manner adapted to the selected gear position.

The present invention is not limited to the above embodiment, but it can be practiced in various forms. For instance, although in the above embodiment, the invention is applied to the direct injection engine which is driven while being switched between the stratified combustion mode and the homogeneous combustion mode, needless to say, it is possible to apply the invention to other types of engines.

Further, the tables in FIGS. 6 to 9 are shown only by way of example, and hence they can be modified as required. For instance, the present invention is applicable to an engine with a variable speed transmission, and in such a case, a correction coefficient corresponding to the coefficient determined from the FIG. 7 table may be set such that it changes steplessly with respect to changes in the change gear ratio.

It is further understood by those skilled in the art that the foregoing is a preferred embodiment of the invention, and that various changes and modifications may be made without departing from the spirit and scope thereof.

What is claimed is:

1. A control system for an internal combustion engine, for setting a desired torque in response to operating conditions of said engine and controlling torque based on said set desired torque, the control system comprising:

rotational speed-detecting means for detecting an engine rotational speed;

accelerator position-detecting means for detecting an accelerator position;

required torque-calculating means for calculating a required torque, based on results of detection by said rotational speed-detecting means and said accelerator position-detecting means;

required torque-smoothing means for smoothing said required torque calculated by said required torque-calculating means;

acceleration-determining means for comparing a present value of said required torque calculated by said required torque-calculating means at a present time with said smoothed required torque smoothed by said required torque-smoothing means, to thereby determine whether or not said engine is being accelerated;

acceleration assist amount-calculating means for calculating an acceleration assist amount, based on a difference value between said present value of said required torque and said smoothed required torque, when said acceleration-determining means determines that said engine is being accelerated; and desired torque-setting means for adding said acceleration assist amount to said smoothed required torque to thereby set said desired torque.

2. A control system according to claim 1, wherein said acceleration assist amount-calculating means calculates said acceleration assist amount such that said acceleration assist amount is progressively increased during a start of said acceleration mode and progressively reduced during an end of said acceleration mode.

3. A control system according to claim 1, wherein said engine includes a transmission, and wherein the control system further comprises change gear ratio-detecting means for detecting a change gear ratio of said transmission of said engine, and wherein said acceleration assist amount-calculating means calculates said acceleration assist amount such that said acceleration assist amount is larger as said change gear ratio detected by said change gear ratio-detecting means is smaller.

4. A control system according to claim 2, wherein said engine includes a transmission, and wherein the control system further comprises change gear ratio-detecting means for detecting a change gear ratio of said transmission of said engine, and wherein said acceleration assist amount-calculating means calculates said acceleration assist amount such that said acceleration assist amount is larger as said change gear ratio detected by said change gear ratio-detecting means is smaller.

5. A control system according to claim 1, wherein said smoothing by said required torque-smoothing means is carried out by calculating an average value of a predetermined number of values of said required torque calculated up to said present time.

6. A control system according to claim 1, further comprising start assist amount-calculating means for calculating a start assist amount based on said engine rotational speed and said accelerator position, and wherein said desired torque-setting means adds said acceleration assist amount and said start assist amount to said smoothed required torque to thereby set said desired torque.

* * * * *